US012704066B2

(12) United States Patent
Fu et al.

(10) Patent No.: US 12,704,066 B2
(45) Date of Patent: Aug. 11, 2026

(54) MINING VEHICLE FOR COBALT-RICH CRUST FROM THE SEABED

(71) Applicant: QINGDAO UNIVERSITY OF SCIENCE AND TECHNOLOGY, Qingdao (CN)

(72) Inventors: Ping Fu, Qingdao (CN); Junfei Wu, Qingdao (CN); Mingwei Chen, Qingdao (CN); Huajian Zhou, Qingdao (CN); Xinglin Du, Qingdao (CN); Xiaonan Zhang, Qingdao (CN)

(73) Assignee: QINGDAO UNIVERSITY OF SCIENCE AND TECHNOLOGY, Qingdao (CN)

( * ) Notice: Subject to any disclaimer, the term of this patent is extended or adjusted under 35 U.S.C. 154(b) by 87 days.

(21) Appl. No.: 19/011,581

(22) Filed: Jan. 6, 2025

(65) Prior Publication Data

US 2025/0243757 A1 Jul. 31, 2025

(30) Foreign Application Priority Data

Jan. 31, 2024 (CN) ..... 202410136883.2

(51) Int. Cl.

| | |
|---|---|
| ***E21C 50/00*** | (2006.01) |
| ***E21C 25/10*** | (2006.01) |
| ***E21C 25/60*** | (2006.01) |
| ***E21C 27/24*** | (2006.01) |

(52) U.S. Cl.

CPC ..... *E21C 50/00* (2013.01); *E21C 25/10* (2013.01); *E21C 25/60* (2013.01); *E21C 27/24* (2013.01)

(58) Field of Classification Search

CPC ..... E21C 50/00; E21C 25/10; E21C 25/60; E21C 27/24

See application file for complete search history.

(56) References Cited

U.S. PATENT DOCUMENTS 2,758,826 A * 8/1956 Paget ..... E21C 27/24 299/87.1
6,003,952 A * 12/1999 Smart ..... E02F 5/006 37/324
9,243,496 B2 * 1/2016 Jones ..... E21C 50/00

FOREIGN PATENT DOCUMENTS

CN 106703812 A * 5/2017 ..... E21C 50/00

* cited by examiner

*Primary Examiner* — Janine M Kreck
(74) *Attorney, Agent, or Firm* — Westbridge IP LLC

(57) ABSTRACT

A mining vehicle for mining cobalt-rich crusts ore from the seabed includes a walking mechanism; a supporting arm, a crushing and collecting mechanism and a hydraulic circulation mechanism. The supporting arm is set on the walking mechanism, and a rotating structure is set at the connection between the supporting arm and the walking mechanism for realizing left-right rotation of the supporting arm; at the same time, the supporting arm can be realized to rotate up and down. The crushing and collecting mechanism is set at the front end of the hydraulic circulating mechanism for crushing the ores. The hydraulic circulating mechanism is set on the supporting arm and the walking mechanism, for collecting the ores, and for promoting flocculation and precipitation of the sediments, and for reducing the degree of particle diffusion.

8 Claims, 9 Drawing Sheets

MINING VEHICLE FOR COBALT-RICH CRUST FROM THE SEABED

CROSS-REFERENCE TO RELATED APPLICATIONS

This application claims priority to Chinese Patent Application No. 202410136883.2, filed on Jan. 31, 2024, the content of which is incorporated herein by reference in its entirety.

TECHNICAL FIELD

The present disclosure relates to the technical field of construction machinery, and specifically relates to a mining vehicle for mining vehicle cobalt-rich crusts from the seabed.

BACKGROUND

Mineral resources, as an important material basis for supporting the national development process, affect more than 90% of China's energy supply and more than 80% of its industrial raw material supply. With the gradual depletion of mineral resources on land, especially in the shallow surface layer, there is an urgent need to find a solution to the problem of persistently high demand for mineral resources, and 75% of the Earth's mineral resources contained in the bottom of the ocean will become the focus of future development, so the development of the oceans and seas is increasingly being emphasized by all countries.

Cobalt-rich crusts is an important seabed mineral resources, has a unique economic value and scientific significance, cobalt-rich crusts are formed by the precipitation of iron, manganese oxides and hydroxides on the hard bedrock of seamounts rich in Mn, Co, Ni and other metals shell-like sedimentary deposits, the thickness of the general for a few millimeters to more than a dozen centimeters, is located mainly in the ocean below the sea level of 800~2500 m without sediment cover. Cobalt, with its high strength, corrosion resistance and high temperature performance, has been widely used in aerospace, battery manufacturing, alloy manufacturing, energy industry and automobile manufacturing. Large-scale mining of cobalt-rich crusts in the deep sea is of great significance to meet the future needs of high-tech product manufacturing and technological innovation. Since most of these seabed mineral resources are located in water depths of thousands of meters or more, the development of deep-sea mineral resources must rely on deep-sea mining equipment.

SUMMARY

According to some embodiments of the present disclosure, a mining vehicle for cobalt-rich crust from the seabed is provided.

The mining vehicle for cobalt-rich crust from the seabed includes a walking mechanism;

a supporting arm, provided on the walking mechanism, and a rotating structure is provided at a connection between the supporting arm and the walking mechanism;

a crushing and collecting mechanism, provided at a front end of a hydraulic circulation mechanism; and a hydraulic circulation mechanism, provided on the supporting arm and the walking mechanism.

Further, the walking mechanism includes a frame, a track, a driving wheel, a tensioning wheel and a supporting wheel; the frame is provided with the driving wheel at a front, the tensioning wheel at a rear, and the supporting wheel at a lower part; the track is provided around the driving wheel, the tensioning wheel and the supporting wheel.

Further, the supporting arm includes a large supporting arm, a small supporting arm, a first hydraulic rod and a second hydraulic rod; the small supporting arm is provided at one end of the large supporting arm and can be rotatably connected to the large supporting arm;

the first hydraulic rod connected the small supporting arm and the large supporting arm for realizing rotation between the small supporting arm relative to the large supporting arm; the second hydraulic rod is connected to the large supporting arm and the rotating structure; and the small supporting arm is provided with a connection box of the hydraulic circulation mechanism.

Further, the hydraulic circulation mechanism includes:

a connection box for mounting a crushing and collecting mechanism, a lower part of the connection box being provided with an ore-collecting port; an ore-collecting pipeline including an ore-collecting hard pipe and a connected ore-collecting pipe, one end of the ore-collecting pipe being connected to the ore-collecting port;

a screening and separating bin, internally provided with a first screening plate, a second screening plate and a third screening plate, with one end of the ore-collecting hard pipe connected to the screening and separating bin;

an ore storage bin body, which is connected to the screening and separation bin, with an ore outlet provided in a lower portion of the ore storage bin body, the ore outlet being connected to an ore output pipe;

a multi-row outlet pipe, provided in an upper part of the connection box, connected to the hydraulic pipe, and a high-pressure jet nozzle is connected to one end of the multi-row outlet pipe;

a hydraulic suction pump, the hydraulic suction pump sucks seawater-sediment from the screening and separation bin, passes through a hydraulic pipeline and a connected multi-row outlet pipe, and sprays seawater-sediment out from a high-pressure jet nozzle; the seawater-sediment repeatedly circulates and flows, so that the seawater-sediment in the vicinity of a crushing roller to maintain a high concentration of sediment particles.

Further, the crushing and collecting mechanism includes: a crushing drum set at a front part of the connecting box in a V-shape, with a power unit set in a middle of the crushing drum; and a spiral collecting drum, at a rear side of the crushing drum, provided on the connecting box via a shaft to which a motor is attached.

Further, the crushing drum is arranged with a V-shaped angle of 165° to 175°.

Further, the rotating structure includes a rotating table and a fixed plate, the rotating table and the fixed plate are rotatably connected; the rotating table is provided with a hydraulic cylinder at one end of the rotating table, and the rotation of the rotating table is pushed by the hydraulic cylinder; and the rotating table is provided with a bracket on an upper end surface for connecting the supporting arm.

Further, the hydraulic cylinder is a double-outlet rod hydraulic cylinder, both ends of the piston rod of the hydraulic cylinder are hingedly connected to the rotating table, and a cylinder barrel is rotatably connected to the fixed plate.

The beneficial effects obtained by the present disclosure are as follows.

By using double crushing drum to mine and crush cobalt-rich crusts on the seabed, and collecting the crushed seabed cobalt-rich crusts by combining the method of spiral drum collecting and hydraulic collection, it solves the problem of low efficiency of seabed cobalt-rich crusts mining and collection. Through the repeated circulation of seawater-sediment flow, it forms the symmetrical two-channel water circulation of collecting ores, which promotes flocculation and precipitation of sediments and reduces the degree of particle diffusion. This mining vehicle has high efficiency and can effectively reduce the pollution damage of seabed environment, which saves the production cost and improves the product quality.

The vehicle uses double crushing drums arranged at a 170° angle for crushing, which is an innovation in the arrangement of crushing drum for the mining vehicle.

BRIEF DESCRIPTION OF THE DRAWINGS

In order to more clearly illustrate the technical solutions of the embodiments of the present disclosure, the accompanying drawings required to be used in the embodiments are briefly described below, it should be understood that the following drawings show certain embodiments of the present disclosure, and therefore should not be regarded as limiting the scope, and for those skilled in the art, other related drawings may be obtained according to these drawings without creative work.

DETAILED DESCRIPTION OF THE EMBODIMENTS

The technical solutions in the embodiments will be clearly and completely described below in conjunction with the accompanying drawings in the embodiments of the present disclosure, and it is clear that the described embodiments are only a part of the embodiments of the present disclosure, and not all of the embodiments. Based on the embodiments, all other embodiments obtained by a person of ordinary skill in the art without making creative labor fall within the scope of protection of the present disclosure.

It should be noted that if the embodiments of the present disclosure involve directional indications (such as up, down, left, right, forward, back), the directional indications are only used to explain the relative positional relationship, movement, etc., among the various components in a particular attitude (as shown in the accompanying drawings), and if the particular attitude is changed, the directional indications are correspondingly changed.

In addition, if the embodiments of the present disclosure have descriptions involving "first", "second", etc., the descriptions of "first", "second", etc. are used only for descriptive purposes, and are not to be understood as indicating or implying their relative importance or implicitly specifying the number of the indicated technical features. As a result, a feature defined as "first" or "second" may include at least one such feature either explicitly or implicitly. In addition, if "and/or" appears throughout the text, it means that three parallel embodiments are included, and "A and/or B", for example, includes an A embodiment, a B embodiment, or an embodiment in which both A and B are satisfied. In addition, the technical solutions between the various embodiments may be combined with each other, but it must be based on the fact that the person of ordinary skill in the field can realize them, and when the combination of the technical solutions is contradictory or unattainable, it should be considered that the combination of the technical solutions does not exist, and is not within the scope of protection of the claims of the present disclosure.

Figure 1:
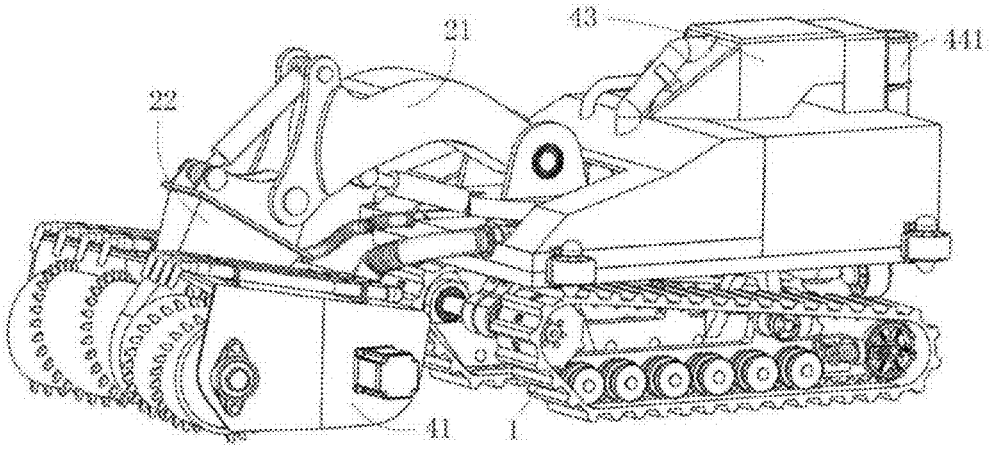
FIG. 1 is a diagram of the overall structure of a mining vehicle.
Figure 2:
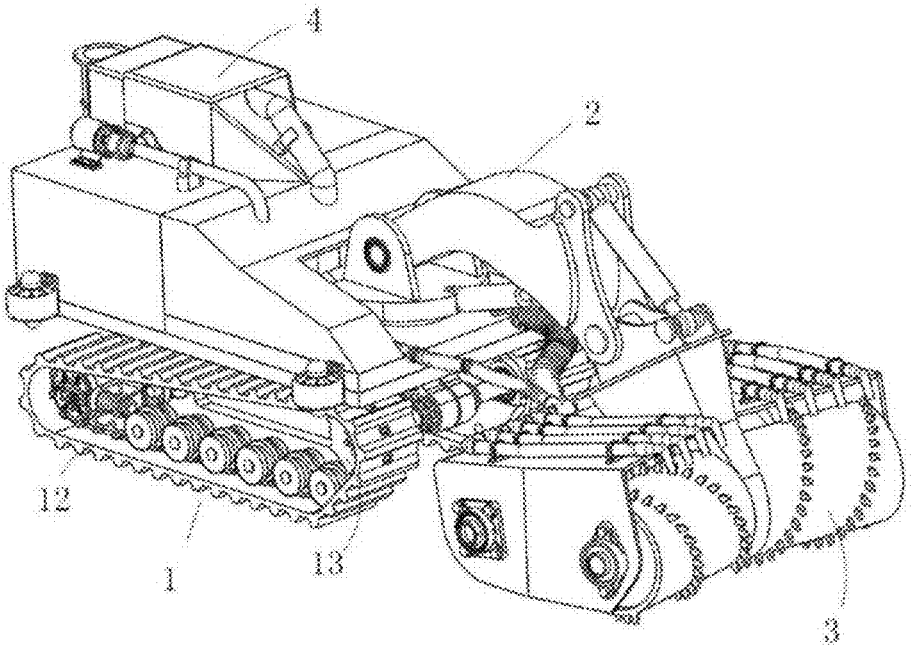
FIG. 2 is a diagram of another angle of the overall structure of a mining vehicle.
Figure 3:
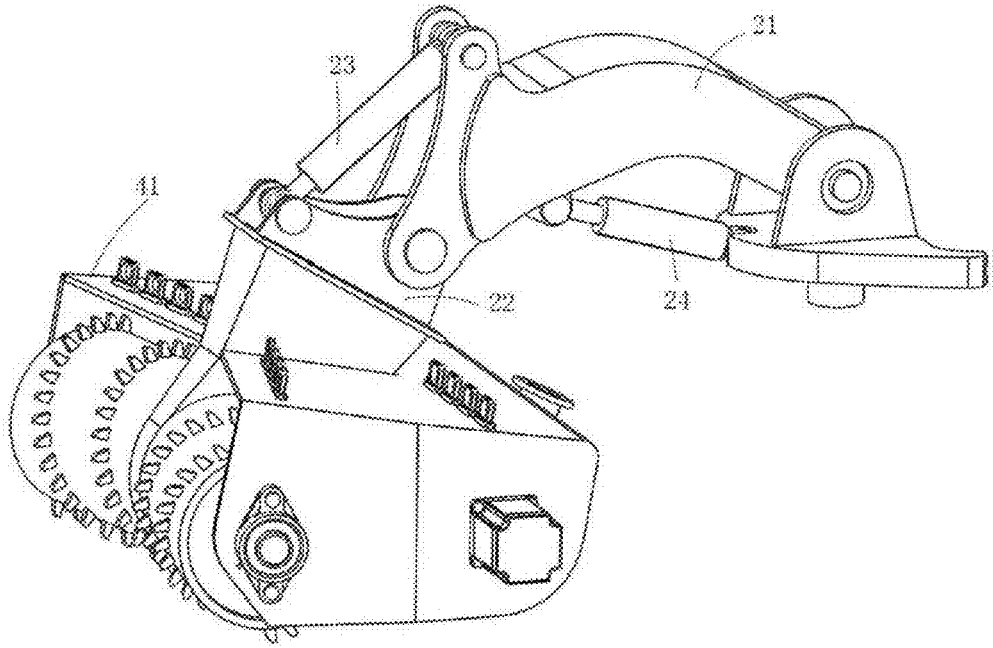
FIG. 3 is a diagram of a supporting arm and crushing structure of a mining vehicle.
Figure 4:
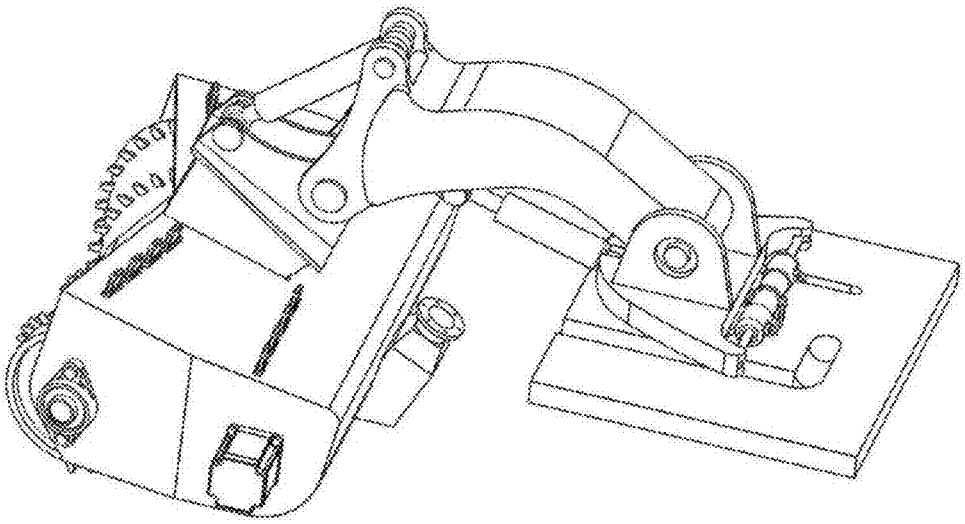
FIG. 4 is a diagram of a supporting arm, a crushing structure and a rotating structure of a mining vehicle.
Figure 5:
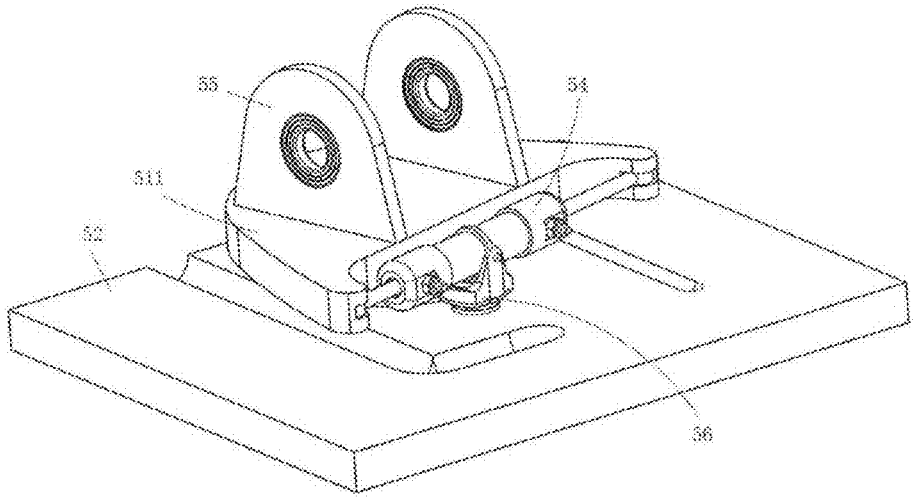
FIG. 5 is a diagram of a three-dimensional view of a rotating structure of a mining vehicle.
Figure 6:
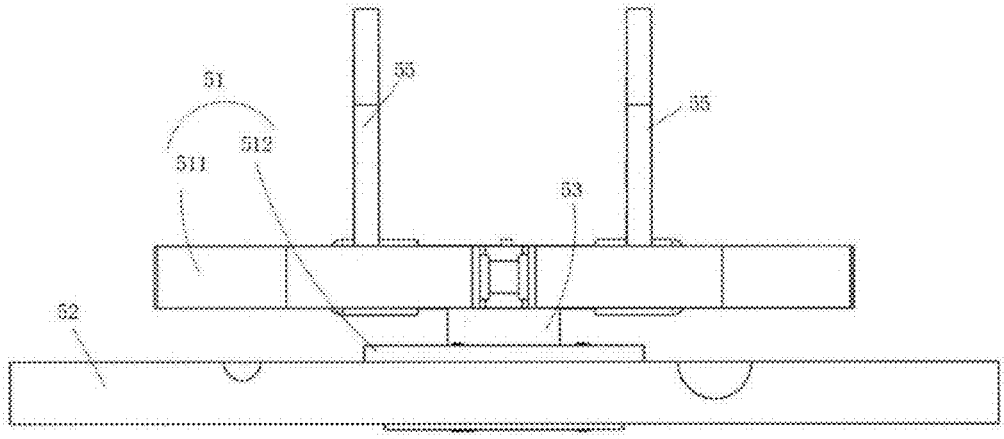
FIG. 6 is a diagram of a front view of the rotating structure of a mining vehicle for mining cobalt-rich crusted ores from the seabed.
Figure 7:
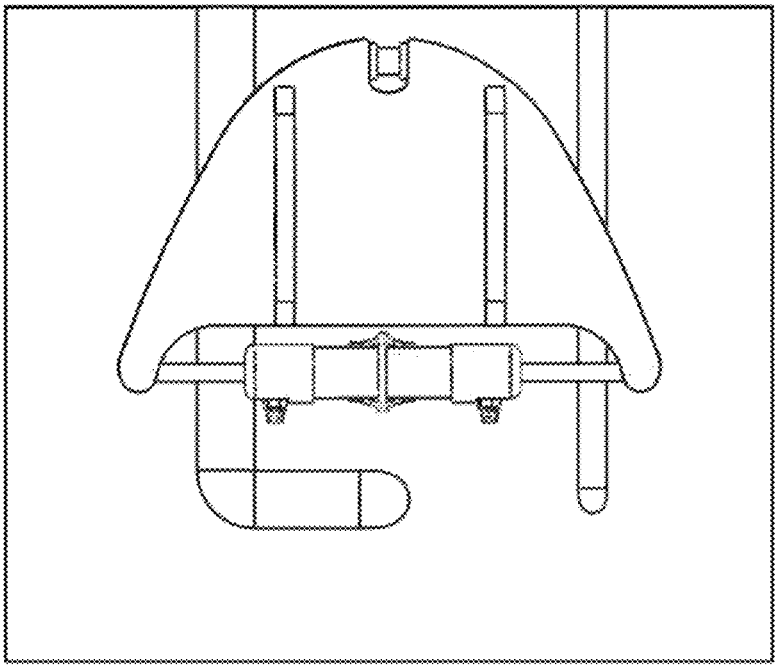
FIG. 7 is a diagram of a top view of the rotary table of a mining vehicle for mining cobalt-rich crusted ores from the seafloor, shown in a non-rotating state.
Figure 8:
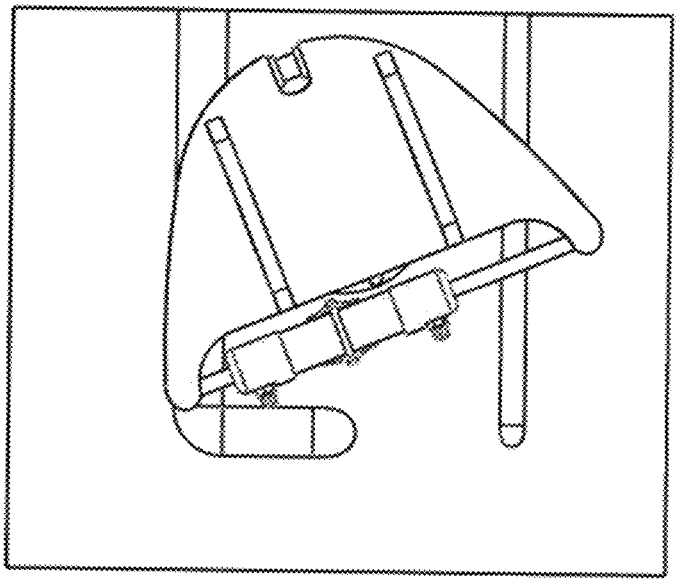
FIG. 8 is a diagram of a mining vehicle rotary table offset 30 degrees to the right for a mining vehicle.
Figure 9:
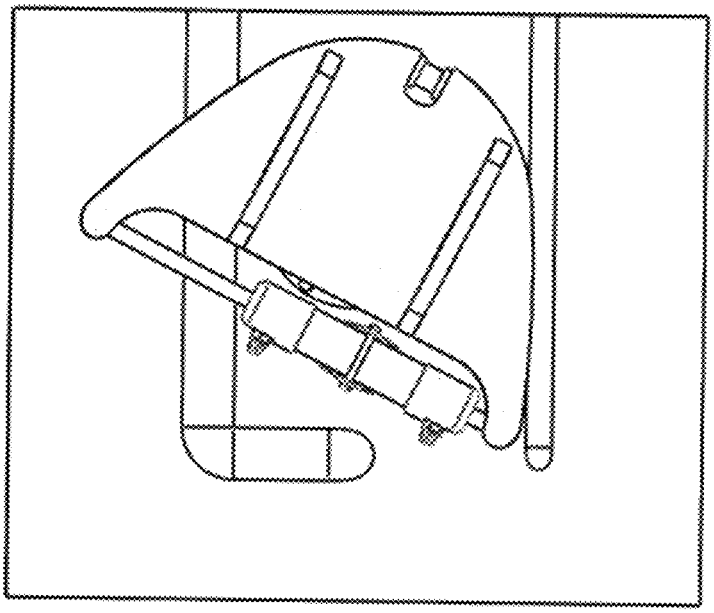
FIG. 9 is a diagram of a mining vehicle rotary table offset 30 degrees to the left for a mining vehicle.
Figure 10:
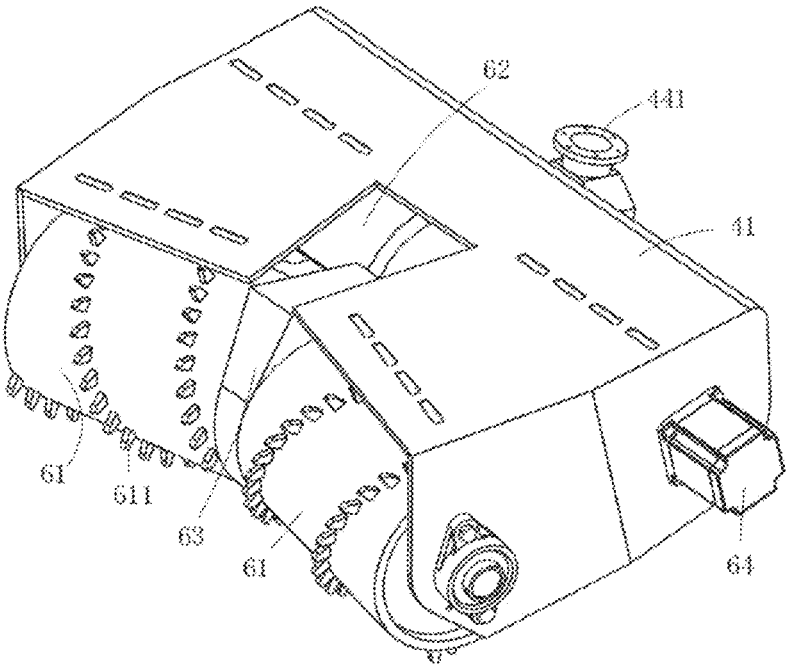
FIG. 10 is a diagram of a three-dimensional view of a crushing and collecting mechanism of a mining vehicle.
Figure 11:
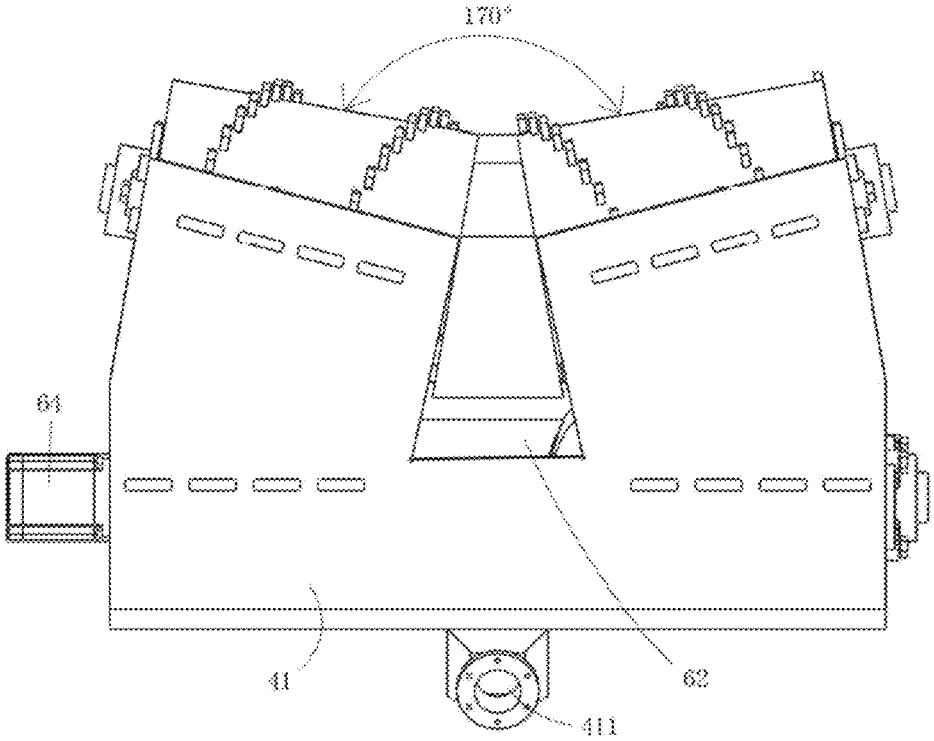
FIG. 11 is a diagram of a top view of a crushing and collecting mechanism of a mining vehicle for mining cobalt-rich crusted ores from the seafloor.
Figure 12:
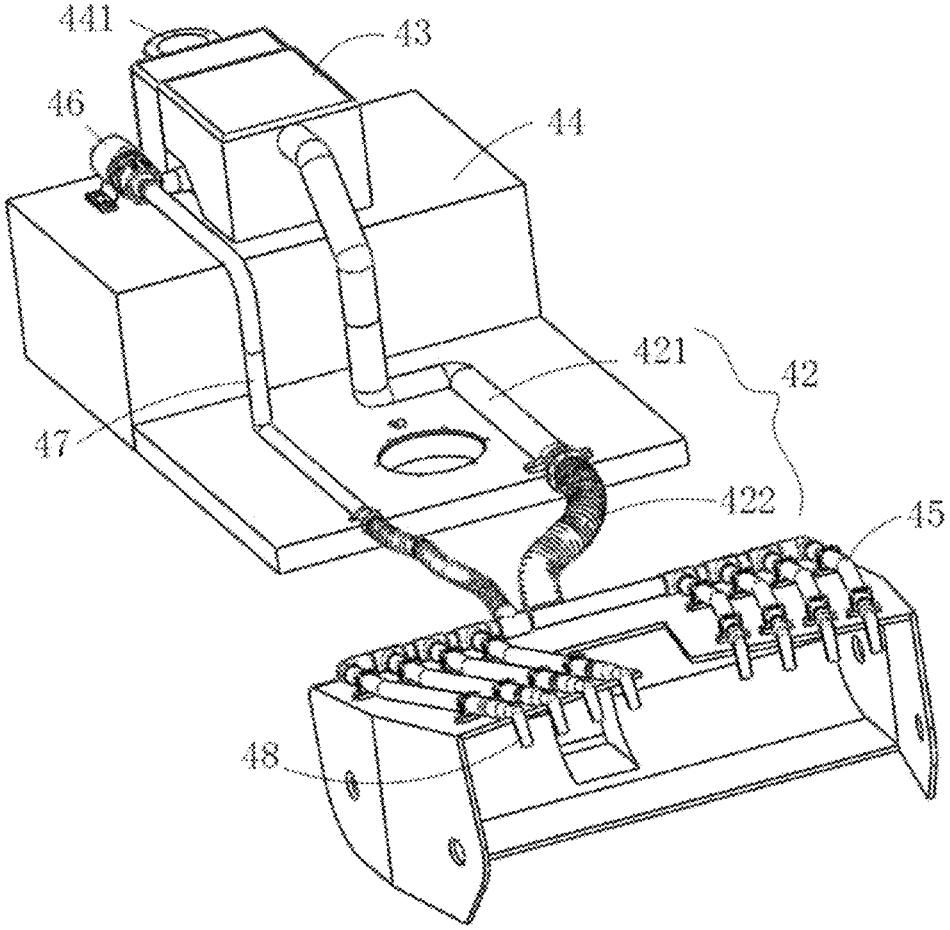
FIG. 12 is a diagram of a three-dimensional view of a hydraulic circulation mechanism of a mining vehicle.
Figure 13:
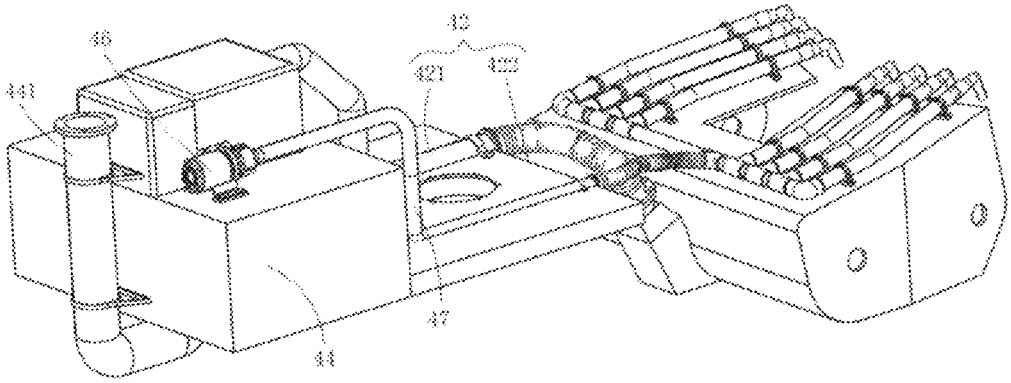
FIG. 13 is a diagram of a three-dimensional view of another angle of the hydraulic circulation mechanism of a mining vehicle.
Figure 14:
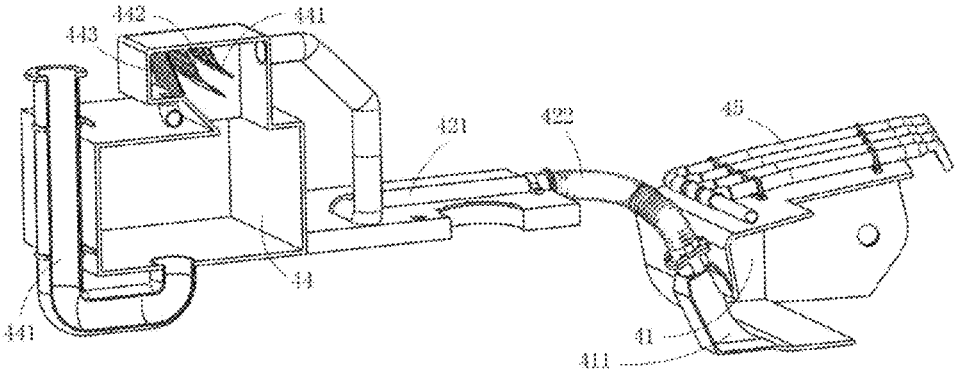
FIG. 14 is a diagram of a cross-sectional view of the hydraulic circulation mechanism of a mining vehicle.
Figure 15:
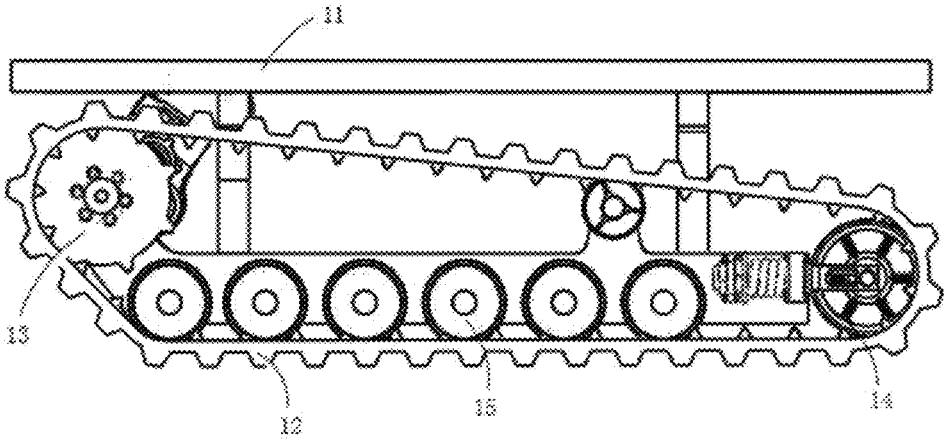
FIG. 15 is a diagram of a side view of a walking mechanism of a mining vehicle.
Figure 16:
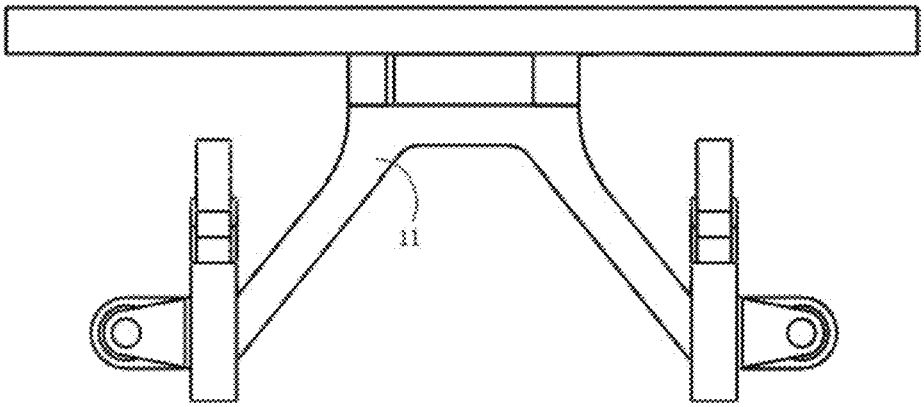
FIG. 16 is a diagram of a front view of the frame of a mining vehicle.
Figure 17:
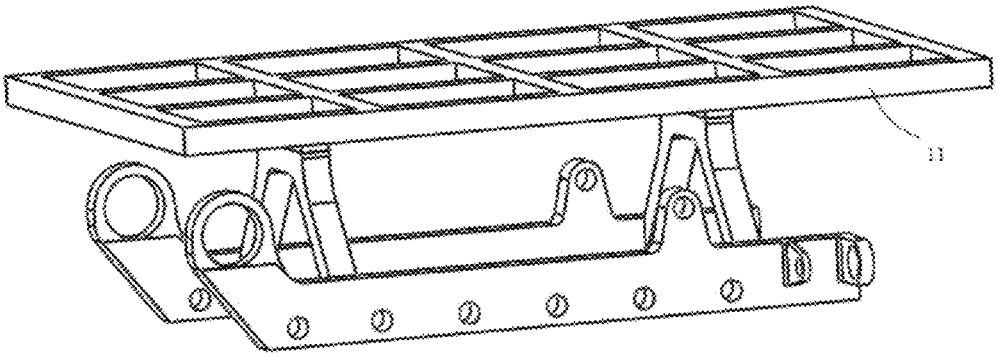
FIG. 17 is a diagram of a three-dimensional view of the frame of a mining vehicle.

As shown in FIG. 1 to FIG. 17, a mining vehicle for cobalt-rich crust from the seabed is provided. The vehicle includes a walking mechanism 1;

- a supporting arm 2, provided on the walking mechanism 1, wherein a rotating structure 5 is provided at a connection between the supporting arm 2 and the walking mechanism 1, for realizing left-right rotation of the supporting arm 2; and up-down rotation can be realized at the same time;
- a crushing and collecting mechanism 3, provided at a front end of a hydraulic circulation mechanism 4, is used for crushing ores; and
- a hydraulic circulation mechanism 4, provided on the supporting arm 2 and the walking mechanism 1, for collecting ores and promoting flocculation and precipitation of sediments and reducing the degree of particle diffusion.

The walking mechanism 1 includes a frame 11, a track 12, a driving wheel 13, a tensioning wheel 14 and a supporting wheel 15; the frame 11 is provided with the driving wheel 13 at a front, the tensioning wheel 14 at a rear, and the supporting wheel 15 at a lower part; the track 12 is provided around the driving wheel 13, the tensioning wheel 14 and the supporting wheel 15.

The supporting arm 2 includes a large supporting arm 21, a small supporting arm 22, a first hydraulic rod 23 and a second hydraulic rod 24; the small supporting arm 22 is provided at one end of the large supporting arm 21 and can be rotatably connected;

the first hydraulic rod 23 connects the small supporting arm 22 and the large supporting arm 21 for realizing rotation between the small supporting arm 22 relative to the large supporting arm 21; the second hydraulic rod 24 connects the large supporting arm 21 and the rotating structure;

the small supporting arm 22 is provided with a connection box 41 of the hydraulic circulation mechanism 4.

The hydraulic circulation mechanism 4 includes:

a connection box 41 for mounting a crushing and collecting mechanism 3, a lower part of the connection box 41 being provided with an ore-collecting port 411; an ore-collecting pipeline 42 including an ore-collecting hard pipe 421 and a connected ore-collecting pipe 422, one end of the ore-collecting pipe 422 is connected to an ore-collecting port 411;

a screening and separating bin 43, internally provided with a first screening plate, a second screening plate and a third screening plate, with one end of the ore-collecting hard pipe 421 connected to the screening and separating bin 43;

an ore storage bin body 44, which is connected to the screening and separating bin 43, with an ore outlet 441 provided in a lower portion of the ore storage bin body 44, the ore outlet 441 being connected to an ore output pipe;

a multi-row outlet pipe 45, provided in the upper part of the connection box 41, is connected to the hydraulic pipe 47, and a high-pressure jet nozzle 48 is connected to one end of the multi-row outlet pipe 45;

a hydraulic suction pump 46, the hydraulic suction pump sucks seawater-sediment from a screening and separating bin 43, passes through a hydraulic pipeline 47 and a connected multi-row outlet pipe 45, and sprays seawater-sediment out from a high-pressure jet nozzle 48; the seawater-sediment repeatedly circulates and flows, so that the seawater-sediment in the vicinity of a crushing roller 61 to maintain a high concentration of sediment particles.

The crushing and collecting mechanism 3 includes: a crushing drum 61 set at the front part of the connecting box 41 in a V-shape, with a power unit 63 set in the middle of the crushing drum 61;

a spiral collecting drum 62, at the rear side of the crushing drum 61, set on the connecting box 41 via a shaft to which a motor 64 is attached.

The crushing drum 61 is arranged with a V-shaped angle of 165° to 175°.

The rotating structure 5 includes a rotating table 51 and a fixed plate 52, the rotating table 51 and the fixed plate 52 are rotatably connected; the rotating table 51 is provided with a hydraulic cylinder at one end of the rotating table 51, and the rotation of the rotating table 51 is pushed by the hydraulic cylinder; and the rotating table 51 is provided with a bracket 55 on an upper end surface for connecting a supporting arm 2.

The hydraulic cylinder is a double-outlet rod hydraulic cylinder 54, both ends of the piston rod of the hydraulic cylinder are hingedly connected to the rotating table 51, and a cylinder barrel is rotatably connected to the fixed plate 52.

The vehicle includes a walking mechanism 1;

a supporting arm 2, provided on the walking mechanism 1, and a rotating structure 5 is provided at the connection between the supporting arm 2 and the walking mechanism 1, for realizing left-right rotation of the supporting arm 2; and up-down rotation can be realized at the same time;

a crushing and collecting mechanism 3, which is provided at the front end of a hydraulic circulation mechanism 4, is used for crushing ores;

a hydraulic circulation mechanism 4, provided on the supporting arm 2 and the walking mechanism 1, for collecting ores and promoting flocculation and precipitation of sediments and reducing the degree of particle diffusion.

The walking mechanism 1 is activated to move the machine to the area of the ore to be crushed. The supporting arm 2 is driven by the rotating structure 5 to realize left and right rotation so as to adjust the position of the crushing and collecting mechanism 3; at the same time, it can be rotated up and down to adjust the position of the crushing and collecting mechanism 3. After the crushing and collecting mechanism 3 crushes the ore, the hydraulic circulation mechanism 4 preliminarily screens the crushed ore. The ore with larger particles is deposited in the water, while the ore with fine particles is returned to the crushing collecting mechanism 3 through a specific pipe under the action of the circulating water flow, increasing the concentration of fine particles at the crushing collecting mechanism 3, promoting flocculation and precipitation of the deposits, and decreasing the degree of particle diffusion.

The walking mechanism 1 includes a frame 11, a track 12, a driving wheel 13, a tensioning wheel 14 and a supporting wheel 15; the frame 11 is provided with the driving wheel 13 at the front, the tensioning wheel 14 at the rear, and the supporting wheel 15 at the lower part; the track 12 is provided around the driving wheel 13, the tensioning wheel 14 and the supporting wheel 15.

The walking mechanism 1 is a track type walking mechanism 1, and the track type walking mechanism 1 can be adapted to various complex terrains and harsh environments. The track 12 is designed as an obtuse triangle type to improve the passability of the vehicle.

Due to the large contact area of the track 12 with the ground, the friction generated is also large, which enables the track type walking mechanism I to have a large driving force, and be able to overcome various obstacles and resistance. The track type walking mechanism 1 can be flexibly steered and moved, and is able to work in a narrow space with high maneuverability. The track type walking mechanism 1 has a low center of gravity and good stability, and is capable of maintaining continuous work for a long time. The track type walking mechanism 1 can carry various heavy equipment or weaponry, and has a strong carrying capacity. The friction between the track 12 and the traveling surface is large and not easy to slip, which can ensure the stability and safety of the walking mechanism 1.

The two support beams of the frame 11 are designed as "herringbone" support beams, which makes the chassis of the mining truck have a larger clearance from the ground, and effectively reduces the phenomenon of cuts on the ground. The herringbone structure can better disperse the load when subjected to force, and improve the overall stability. In the working environment of the mining truck, stability is very important, so as to avoid the equipment in the work of tipping or frame 11 deformation. The design of the herringbone support beam reduces the distribution of concentrated stresses, thereby reducing the possibility of metal fatigue and corrosion and increasing its service life. Herringbone support beams are relatively simple to construct and therefore relatively inexpensive to manufacture. This can effectively reduce costs for large equipment such as mining vehicle.

The supporting arm 2 includes a large supporting arm 21, a small supporting arm 22, a first hydraulic rod 23 and a second hydraulic rod 24; the small supporting arm 22 is provided at one end of the large supporting arm 21 and can be rotatably connected;

The first hydraulic rod 23 connects the small supporting arm 22 and the large supporting arm 21 for realizing rotation between the small supporting arm 22 relative to the large supporting arm 21; the second hydraulic rod 24 connects the large supporting arm 21 and the rotating structure;

The first hydraulic rod 23 drives the small supporting arm 22 to rotate relative to the large supporting arm 21 in order to adjust the position of the crushing hammer head. At the same time, the hydraulic lever two 24 drives the large supporting arm 21 to rotate relative to the rotating table 51 to further adjust the position of the crushing hammer head.

The small supporting arm 22 is provided with a connection box 41 of the hydraulic circulation mechanism 4.

The connecting box 41 is provided with a crushing and collecting mechanism 3 for ore crushing; the connecting box 41 is connected by an ore-collecting pipe 422 to avoid the movement of the connecting box 41 being restricted.

Hydraulic circulation mechanism 4 includes:

- a connection box 41 for mounting a crushing and collecting mechanism 3, the lower part of the connection box 41 being provided with an ore-collecting port 411;
- an ore-collecting pipeline 42 including an ore-collecting hard pipe 421 and a connected ore-collecting pipe 422, the ore-collecting pipe 422 being one end is connected to an ore-collecting port 411;
- a screening and separating bin 43, internally provided with a first screening plate, a second screening plate and a third screening plate, with one end of the ore-collecting hard pipe 421 connected to the screening and separating bin 43;
- an ore storage bin body 44, which is connected to the screening and separating bin 43, with an ore outlet 441 provided in a lower portion of the ore storage bin body 44, the ore outlet 441 being connected to an ore output pipe;
- a multi-row outlet pipe 45, provided in the upper part of the connection box 41, is connected to the hydraulic pipe 47, and a high-pressure jet nozzle 48 is connected to one end of the multi-row outlet pipe 45;
- a hydraulic suction pump 46, which sucks seawater-sediment from a screening and separating bin 43, passes through a hydraulic pipeline 47 and a connected multi-row outlet pipe 45, and sprays it out from a high-pressure jet nozzle 48; the seawater-sediment repeatedly circulates and flows, so that the seawater-sediment in the vicinity of a crushing roller 61 to maintain a high concentration of sediment particles.

After the crushing and collecting mechanism 3 crushes the ore, the crushed ore falls into the connecting box 41, and enters the ore-collecting pipeline 42 through the ore-collecting port 411. The ore-collecting pipeline 42 conveys the crushed ore to the screening and separating bin 43. Inside the screening and separating bin 43, the ore undergoes screening by the first screening plate, the second screening plate and the third screening plate. The screened ore enters the ore storage bin 44, and the lower part of the ore storage bin 44 is provided with an ore outlet 441, which is connected to an ore output pipe to convey the screened ore to the outside. The multi-row outlet pipe 45 is provided in the upper part of the connection box 41, which is connected to the hydraulic pipe 47. A high-pressure jet nozzle 48 is connected to one end of the multi-row outlet pipe 45 for generating a high-velocity water flow. The hydraulic suction pump 46 draws seawater and sediment from the screening and separation bin 43, which is ejected from the high-pressure jet nozzle 48 through the hydraulic pipe 47 and the connected multi-row outlet pipe 45. This high-velocity water flow further breaks up fine ore particles while promoting flocculation and sedimentation of the sediments and reducing the degree of particle spreading. The seawater sediment that has been repeatedly circulated and flowed maintains a high concentration of sediment particles in the nearby crushing drum 61, which improves the recovery efficiency of the ore. The hydraulic circulation mechanism 4 achieves efficient treatment and utilization of the ore through a series of screening, separation, storage and circulation flow processes. This design enables the machine to be better adapted to different working environments and demands, further enhancing its working efficiency and stability.

The crushing and collecting mechanism 3 includes: the crushing drum 61 set at the front part of the connecting box 41 in a V-shape, with a power unit 63 set in the middle of the crushing drum 61, the cylindrical side of the crushing drum 61 is provided with a cutting pick 611, the cutting pick 611 being spirally arranged.

- a spiral collecting drum 62, at the rear side of the crushing drum 61, set on the connecting box 41 by means of a shaft to which a motor 64 is attached.

The crushing drum 61 rotates under the drive of the power unit 63, and the V-shaped crushing drum 61 gradually crushes the ore. The cutting pick 611 of the crushing drum 61 are designed to enable better crushing of the ore, and the crushed ore falls into the spiral collecting drum 62, which rotates under the drive of the motor 64 to collect the crushed ore, and the collected ore is transported through a specific pipeline to the hydraulic circulation mechanism 4 for further screening and separation.

The power box is powered by cables lowered from the sea support vessel, and the upper end is fixedly connected to the connection box 41, and two crushing drums 61 are connected to the left and right sides respectively; the crushing drum 61 is driven to rotate by the power box, and there are crushing interceptor teeth arranged in a spiral around the circumference of the crushing drum 61 to cut and crush the ores; furthermore, the crushing drum 61 are mounted two side-by-side at an angle of 170°, with one end further, the crushing drum 61 is mounted two side by side at an angle of 170°, with one end connected to the power box and one end connected to the bearing seat in an inwardly converging shape; the collection cover covers the power box and the spiral collecting drum 62, as well as the crushing drum 61, preventing the crushed ore from flying out; the spiral collecting drum 62 is connected to the rear part of the collection cover, and there are spirally arranged blades on the circumference of the spiral collecting drum 62; the electric motor 64 is fixedly connected to the right side of the collection cover, and is connected to the spiral collecting drum 62 to rotate it; the ore-collecting port is located in the middle of the rear of the collecting cover and is connected with the ore-collecting pipeline 42. The crushed ore is gathered at the ore-collecting port through the spiral collecting drum 62 and is collected and transported through the ore-collecting pipeline 42.

The rotating structure 5 includes a rotating table 51 and a fixed plate 52, the rotating table 51 and the fixed plate 52 being rotatably connected; the rotating table 51 is provided with a hydraulic cylinder at one end of the rotating table 51, and a rotation of the rotating table 51 is pushed by the hydraulic cylinder; the rotating table 51 is provided with a bracket 55 on the upper end surface for connecting a supporting arm 2.

The hydraulic cylinder is a double-outlet rod hydraulic cylinder 54, both ends of the piston rod of the hydraulic cylinder are hingedly connected to the rotating table 51, and a cylinder barrel is rotatably connected to the fixed plate 52.

The rotating table 51 is hingedly connected to both ends of the piston rod of the double outlet rod hydraulic cylinder 54; the upper circle of the rotatable supporting seat 56 is fixedly connected to the middle part of the cylinder body of the double outlet rod hydraulic cylinder 54, and the lower end of the rotatable supporting seat 56 is moved on the fixed plate 52 according to a certain trajectory groove, and the piston rod extends to the left under the action of the double outlet rod hydraulic cylinder 54 which can drive the rotating table 51 to rotate to the right, and similarly to rotate to the left; a upper disk 511 of the rotary table is fixedly connected to a rotation axis 53; the rotation axis 53 and a lower disk 512 of the rotary table are rotated through a bearing, and the lower disk 512 of the rotary table is fixedly connected to the fixed plate 52. The upper disk 511 of the rotary table is fixedly connected to the rotary shaft 53; the rotary shaft 53 is rotationally connected to the lower disk 512 of the rotary table through a bearing, and the lower disk 512 of the rotary table is fixedly connected to the fixed plate 52. The upper disk 511 of the rotary table rotates to drive the large supporting arm 21 to rotate in the left and right directions, thereby enabling the crushing and collecting device to realize movement in multiple directions, making the mining vehicle more flexible and more efficient.

The above is only an optional embodiment of the present disclosure, and is not intended to limit the patent scope of the present disclosure, and any equivalent structural transformations made by utilizing the contents of the specification of the present disclosure and the accompanying drawings under the inventive concept of the present disclosure, or directly/indirectly utilized in other related technical fields are included in the patent protection scope of the present disclosure.

What is claimed is:

1. A mining vehicle for cobalt-rich crust from the seabed, comprising:

a walking mechanism;

a supporting arm, provided on the walking mechanism, wherein a rotating structure is provided at a connection between the supporting arm and the walking mechanism;

a crushing and collecting mechanism, provided at a front end of a hydraulic circulation mechanism; and a hydraulic circulation mechanism, provided on the supporting arm and the walking mechanism.

2. The vehicle according to claim 1, wherein the walking mechanism comprises a frame, a track, a driving wheel, a tensioning wheel and a supporting wheel; the frame is provided with the driving wheel at a front, the tensioning wheel at a rear, and the supporting wheel at a lower part; the track is provided around the driving wheel, the tensioning wheel and the supporting wheel.

3. The vehicle according to claim 1, wherein the supporting arm comprises a large supporting arm, a small supporting arm, a first hydraulic rod and a second hydraulic rod; the small supporting arm is provided at one end of the large supporting arm and can be rotatably connected to the large supporting arm;

the first hydraulic rod is connected to the small supporting arm and the large supporting arm for realizing rotation between the small supporting arm relative to the large supporting arm; the second hydraulic rod is connected to the large supporting arm and the rotating structure; and the small supporting arm is provided with a connection box of the hydraulic circulation mechanism.

4. The vehicle according to claim 1, wherein the hydraulic circulation mechanism comprises:

a connection box for mounting a crushing and collecting mechanism, a lower part of the connection box being provided with an ore-collecting port;

an ore-collecting pipeline comprising an ore-collecting hard pipe and a connected ore-collecting pipe, one end of the ore-collecting pipe being connected to the ore-collecting port;

a screening and separating bin, internally provided with a first screening plate, a second screening plate and a third screening plate, with one end of the ore-collecting hard pipe connected to the screening and separating bin;

an ore storage bin body, connected to the screening and separation bin, with an ore outlet provided in a lower portion of the ore storage bin body, the ore outlet being connected to an ore output pipe;

a multi-row outlet pipe, provided in an upper part of the connection box, connected to the hydraulic pipe, wherein a high-pressure jet nozzle is connected to one end of the multi-row outlet pipe; and a hydraulic suction pump, wherein the hydraulic suction pump sucks seawater-sediment from the screening and separation bin, passes through a hydraulic pipeline and a connected multi-row outlet pipe, and sprays seawater-sediment out from the high-pressure jet nozzle; the seawater-sediment repeatedly circulates and flows, so that the seawater-sediment in the vicinity of a crushing roller to maintain a high concentration of sediment particles.

5. The vehicle according to claim 1, wherein the crushing and collecting mechanism comprises: a crushing drum set at a front part of the connecting box in a V-shape, with a power unit set in a middle of the crushing drum; and a spiral collecting drum, at a rear side of the crushing drum, provided on the connecting box via a shaft to which a motor is attached.

6. The vehicle according to claim 5, wherein the crushing drum is arranged with a V-shaped angle of 165° to 175°.

7. The vehicle according to claim 1, wherein the rotating structure comprises a rotating table and a fixed plate, the rotating table and the fixed plate are rotatably connected;

the rotating table is provided with a hydraulic cylinder at one end of the rotating table, and the rotation of the rotating table is pushed by the hydraulic cylinder; and the rotating table is provided with a bracket on an upper end surface for connecting the supporting arm.

8. The vehicle according to claim 7, wherein the hydraulic cylinder is a double-outlet rod hydraulic cylinder, both ends of a piston rod of the hydraulic cylinder are hingedly connected to the rotating table, and a cylinder barrel is rotatably connected to the fixed plate.

* * * * *